US007400260B2

(12) United States Patent
Levine

(10) Patent No.: US 7,400,260 B2
(45) Date of Patent: Jul. 15, 2008

(54) OPTICAL SYSTEM AND ELEMENT FOR DETECTING ICE AND WATER

(75) Inventor: Paul Levine, Valhalla, NY (US)

(73) Assignee: Safe Flight Corporation, White Plains, NY (US)

( * ) Notice: Subject to any disclaimer, the term of this patent is extended or adjusted under 35 U.S.C. 154(b) by 411 days.

(21) Appl. No.: 11/168,363

(22) Filed: Jun. 29, 2005

(65) Prior Publication Data

US 2007/0001861 A1 Jan. 4, 2007

(51) Int. Cl.
*G08B 19/02* (2006.01)

(52) U.S. Cl. ..... 340/583; 340/580; 340/581; 340/582; 340/962; 250/341; 250/339.07

(58) Field of Classification Search ..... 340/583, 340/580, 581, 582, 962; 250/341, 339.07
See application file for complete search history.

(56) References Cited

U.S. PATENT DOCUMENTS 3,362,224 A 1/1968 Melone
4,766,369 A 8/1988 Weinstein
4,782,331 A 11/1988 Martens
4,797,660 A * 1/1989 Rein, Jr. ..... 340/583
4,803,470 A 2/1989 Fineman
4,851,817 A 7/1989 Brossia et al.
5,014,042 A 5/1991 Michoud et al.
5,296,853 A * 3/1994 Federow et al. ..... 340/962
6,425,286 B1 * 7/2002 Anderson et al. ..... 73/170.26
6,762,409 B2 * 7/2004 Fritsch et al. ..... 250/339.07

* cited by examiner

*Primary Examiner*—Tai Nguyen
(74) *Attorney, Agent, or Firm*—Cohen Pontani Lieberman & Pavane LLP

(57) ABSTRACT

An optical system for detecting ice and water on the surface of an aircraft includes an elongated transparent optical element having first and second end portions. A light source and light detector are disposed in one end of the optical element and a reflective surface is disposed in the opposite end portion. The reflective surface defines a critical angle and reflects light from the light source to the light detector when the critical angle is in contact with air and refracts the light toward the external environment when the reflective surface is in contact with ice or water. The system may also incorporate an optical element wherein the reflective surface includes a continuous array of convex elements extending outwardly from and across one end of the optical element and wherein each of the convex elements defines a critical angle.

8 Claims, 2 Drawing Sheets

OPTICAL SYSTEM AND ELEMENT FOR DETECTING ICE AND WATER

FIELD OF THE INVENTION

This invention relates to a system and element for detecting and/or enunciating ice and water on the surface of an aircraft and for distinguishing between ice and water.

BACKGROUND FOR THE INVENTION

The accumulation of ice on various surfaces of an aircraft can produce disastrous results. Accordingly, it is important for a pilot to know when ice starts to appear and to take measures to avoid serious consequences. For example, a pilot may turn on surface heaters, make changes in speed or elevation, changes in the angle of attack and/or seek the nearest airport before the problem becomes critical.

A U.S. Pat. No. 4,851,817 of Brossia et al. discloses a system for automatic and real time detection of water and icing on surfaces by monitoring variations in light energy transmitted through an optical fiber having a specially processed sensitive area probe. The sensitive area probe is positioned on, about or within the surface on which icing is to be detected. Because of differences in optical indices of refraction and energy absorption characteristic of air, water and ice, the presence of each of these at the process sensitive area will cause a proportional and characteristic attenuation of the light energy passing through the optical fiber. Changes in light energy transmission can be interpreted automatically to provide an indication of icing. A referenced optical circuit may be used to provide compensation for variations in input energy levels. Light energy of different wavelengths and energy levels may be used to compensate for or avoid interference with measurement by ambient lighting conditions or for the detection of other conditions and materials using the principle of characteristic absorption and resonance.

A more recent approach to an Ice Detector, Especially for Aircraft is disclosed by Michaoud et al. in U.S. Pat. No. 5,014,042. As disclosed therein, a source sends light towards a receiver through an optical channel, a part of which has an interface with the external environment. The light that reaches this interface is reflected toward the receiver when the external environment is in contact with air and is refracted toward the external environment in the presence of water or ice. In streaming down the interface, the rain creates a modulation, not created by ice in the signal of the receiver. The circuits down line of the receiver search for this modulation to determine whether the modifications of the signal of the receiver are due to rain or ice.

Notwithstanding the above, it is presently believed that there may be a large commercial market for an improved optical system and element for detecting ice and water on the surface of an aircraft in accordance with the present invention. A commercial market should develop because the improved systems and elements in accordance with the present invention warn a pilot of a hazardous icing condition, enables a pilot to distinguish between ice and water, as well as conditions when icing may be imminent. It is presently believed that such systems can be manufactured and sold at a competitive costs, can be readily installed on new aircraft as well as retrofitted on existing aircraft, are compact, durable, accurate and readily serviced. Further advantages will become evident from the following specification.

BRIEF SUMMARY OF THE INVENTION

In essence, the present invention contemplates an improved optical system for detecting ice and water on the surface of an aircraft. The system includes an elongated transparent optical element having proximal and distal end portions and a light source for generating a beam of light disposed in the distal portion of the transparent optical element. The system also includes a light detector and means for generating variable signals dependent on the amount of light received by said detector which is disposed in the distal portion of the transparent optical element. The transparent optical element also includes a reflective surface in the proximal portion of the optical element and an optical channel for transmitting light from the light source to the reflective surface and reflected light from said reflective surface to the light detector. An important element in the present invention resides in the reflective surface which defines a critical angle disposed on, about or within a surface of an aircraft. Means are also provided for pulsating the light source and means including a demodulator and filter for limiting the response from the light detector to light reflected from the light source. A first embodiment of the invention also includes first comparator means for comparing the reflected light from the light detector to a light threshold and second comparator means for comparing the temperature from the temperature sensor to a temperature threshold. Signals from the two comparator circuits are fed to an And circuit, the output of which indicates the presence of ice or water.

A second embodiment of the invention contemplates an improved optical element for use in detecting ice and water on the surface of an aircraft. The optical element includes an elongated transparent body which defines an optical channel. The transparent body also includes a first portion at one end thereof and a second portion at an opposite end. A light source for generating a beam of light and a light detector and means for generating variable signals dependent on the amount of light received by the detector are disposed in the first portion of the elongated transparent body. A reflective surface is disposed in the second portion and comprises a plurality of convexed elements extending outwardly from an opposite end of the elongated transparent body. Each of the convexed elements defines a critical angle so that light from the light source is reflected by the convexed element toward the light detector when the convexed elements are in contact with the air and refracted toward the external environment when the convexed elements are in contact with ice or water.

The invention will now be described in connection with the accompanying figures wherein like elements are identified by like numbers.

DESCRIPTION OF THE PREFERRED EMBODIMENTS OF THE INVENTION

Figure 2:
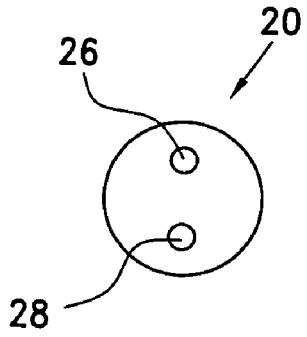
FIG. 2 is an end view of the optical element shown in FIG. 1.
Figure 1:
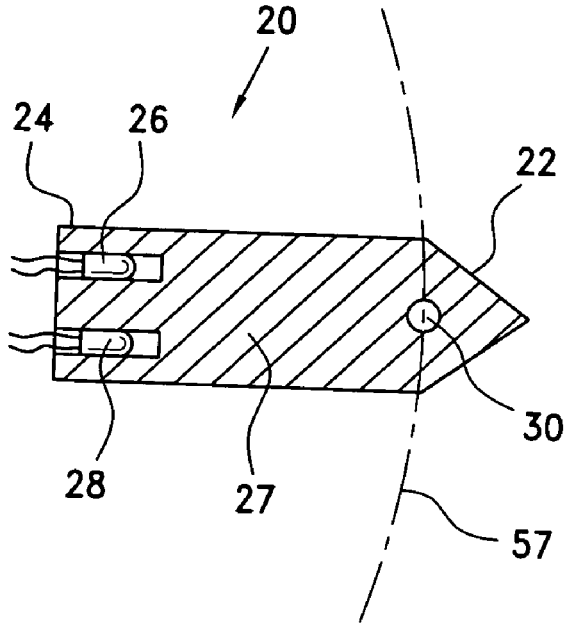
FIG. 1 is a schematic side view of an optical element for use in an optical system in accordance with the present invention.

FIGS. 1 and 2 illustrate an ice detector element 20 of the type used in an optical system in accordance with a first embodiment of the invention. The element 20 comprises an elongated transparent body of glass, quartz or plastic with a proximal end portion 22 and opposite or distal end portion 24. The proximal end portion 22 defines a prism or cone shape with a critical angle preferably at or about 90°. This critical angle is determined by the material properties as will be well understood by persons of ordinary skill in the art.

The use of a critical angle is based on the principle that the reflection or refraction of light at the surface of an optical body is changed when the surface is covered with ice or water as opposed to air. Further details on the shapes, materials and other parameters of a critical angle are disclosed in the U.S. Patent of Martens, No. 4,782,331 which is incorporated herein in its entirety by reference.

A light source 26 which may be in the form of an electro luminescent diode or other suitable illuminator is disposed in the distal portion 24 of the element 20 and is adapted to project a beam of light toward the proximal end portion 22. In the present invention, an OP 232 source from Optec Technology, Inc. from Carrolton Tex. is used. The element 20 also includes a light detector 28, an Optec OP 800A, in the distal portion 24 for receiving reflected light from the proximal end portion 22. For example, when the pointed end of the proximal end portion 22 is in contact or immersed in air, light from the light source 26 will be totally reflected toward and detected by the light detector 28. However, if the proximal end portion 22 is immersed in ice or water, the light from the light source 26 will be totally refracted toward the external environment i.e., will pass through the proximal end portion which results in a dark phase as received by the detector 28.

An important feature of the present invention resides in a temperature sensor 30 which is preferably disposed in a proximal end portion 22 of the element 20 for sensing the temperature at the surface of an aircraft. The temperature sensor 30 may be of any conventional design that is compact and suitable for the purpose, as for example, a thermistor. The temperature sensor is used to distinguish the difference between ice and water. For example, if the temperature is above 32° F. the substance covering the proximal end is assumed to be water and if below 32° F. it is assumed to be ice. It can also be recognized that at 32° plus or minus a reasonable increment may indicate that icing is imminent.

Figure 3:
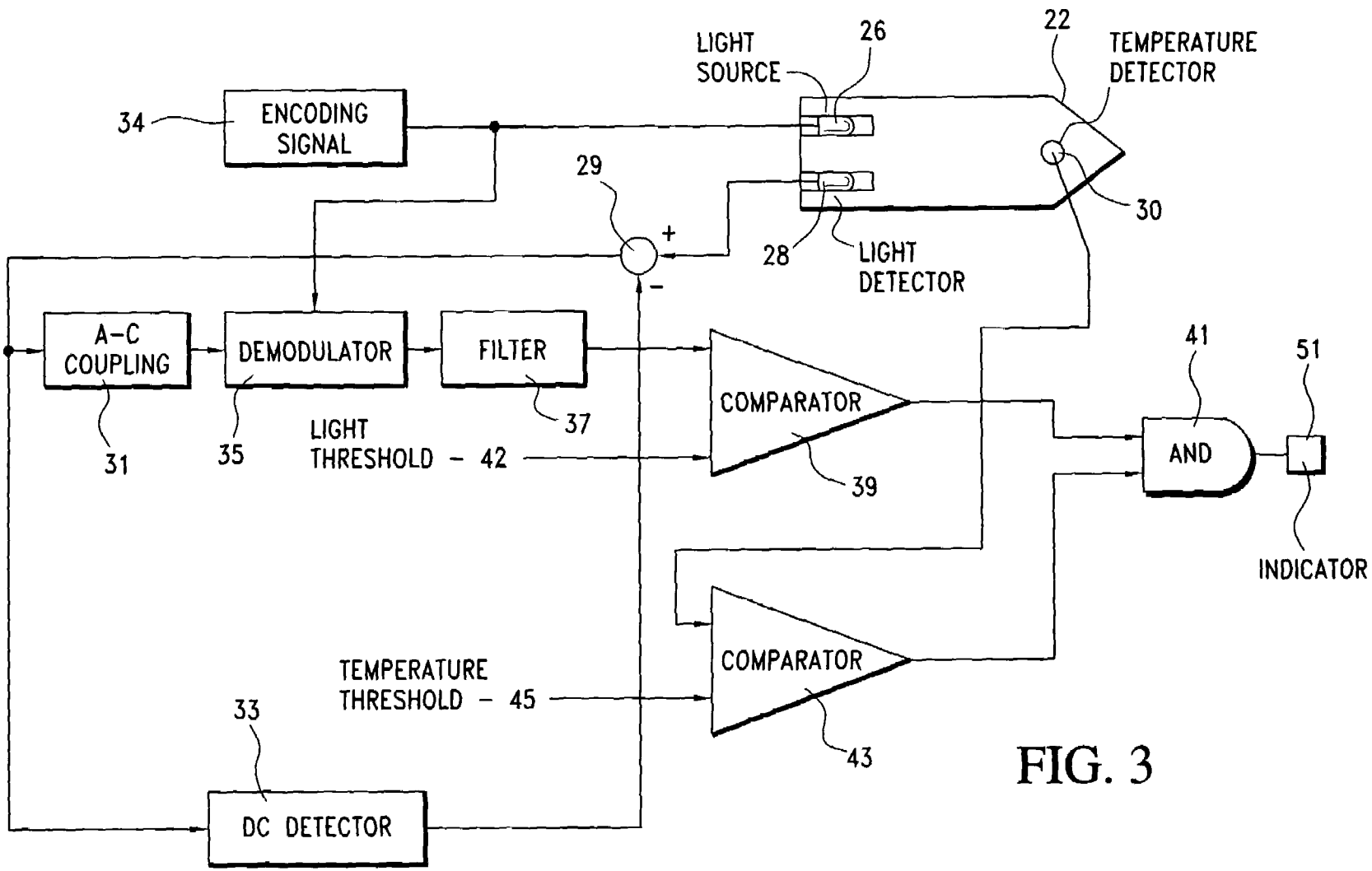
FIG. 3 is a schematic diagram of an optical system in accordance with a first embodiment of the invention.

As shown in FIG. 3, a first embodiment of the invention includes means for encoding a signal 34 such as a signal generator for producing a 400-hertz sine wave. The means for encoding a signal 34 pulses the light source 26. The pulsed light passes through the elongated transparent body 27 and is reflected or refracted at the proximal end portion 22. Reflected light is detected by the light detector 28 and produces a signal that is fed to a summing junction 29. The signal from the summing junction 29 is fed to an A-C coupling 31 after subtraction of a DC component 33 at the summing junction 29. The encoding signal from the means for encoding a signal 34 and a signal from the AC coupling 31 are both fed to a demodulator 35 and through a filter 37 to a comparator circuit 39. In this way any light that is incident upon the proximal portion 22 is eliminated. A light threshold signal generator 42 is also fed to the comparator circuit 39, the output of which is fed to an And circuit or gate 41.

At the same time, a signal from the temperature sensor 30 is fed to a second comparator circuit 43 and compared to a threshold temperature signal 45 and the output fed to the And circuit or gate 41. The output of the And gate 41 is fed to an indicator or enunciator 47 as an indication of ice or water on the surface 51 of the aircraft. In the event that light from the light source 26 is refracted to the environment, the light detector will sense a darkness as an indication of ice or water. This indication then compares the actual temperature with a threshold temperature and when the threshold temperature is less than 32° it is an indication of ice while an indication of above 32° would indicate water on the surface of the aircraft.

Figure 4:
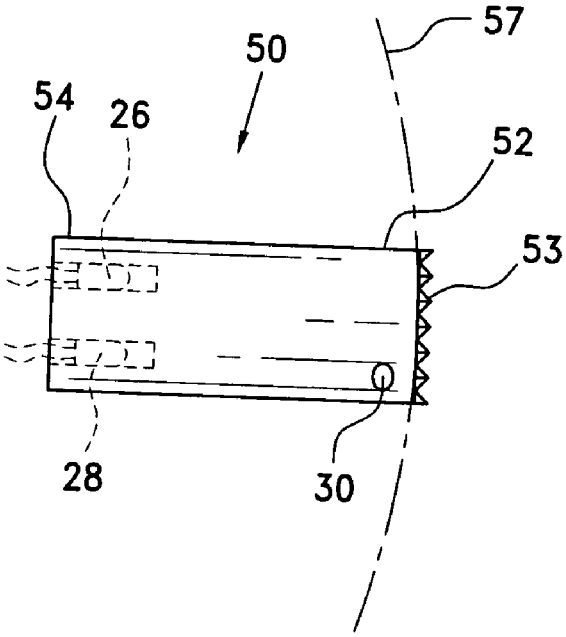
FIG. 4 is a schematic illustration of an optical element in accordance with a second embodiment of the invention.
Figure 5:
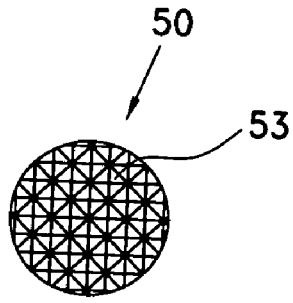
FIG. 5 is a front view of the optical element shown in FIG. 4.

As shown in FIGS. 4 and 5, an ice detector element 50 in accordance with a second embodiment of the invention includes an elongated transparent body having a cylindrical shape with a proximal end portion 52 and distal end portion 54. The proximal end portion 52 defines a continuous array 53 of convex elements extending outwardly from and across the proximal end portion 52 of the elongated transparent body. Each of the convex elements defines a critical angle and may have a prism or cone shape. It is presently believed that a depth of less than 0.25 inches for each of these elements is preferred. This shallow depth reduces the height of a single element extending outwardly form the surface 57 of an aircraft.

A light source 26 is disposed in the distal end portion 54 of the element 50 and is adapted to project a beam of light toward the proximal end portion 52. The element 50 also includes a light detector 28 in the distal end portion 54 for receiving reflected light from the proximal end portion 52. For example, when the pointed ends of the proximal end portions are in contact with or immersed in air light from the light source 26 will be totally reflected and detected by the light detector 28. Then if the proximal end portion 52 is emerged in ice or water the light from the light source 26 will be totally refracted toward the external environment i.e., will pass through the proximal end portion which will result in a dark phase as viewed by the detector 28. Similarly to the first embodiment of the present invention, a temperature sensor 30 is disposed in the proximal end portion 52 of the element 50 for sensing the temperature at the surface 57 of an aircraft.

While the invention has been described in connection with its preferred embodiments, it should be recognized that changes and modifications may be made therein without departing from the scope of the appended claims.

What is claimed is:

1. An optical system for detecting ice and water on the surface of an aircraft, said system comprising:

an elongated transparent optical element having proximal and distal end portions;

a light source for generating a beam of light disposed in said distal end portion;

a light detector and means for generating a variable signal dependent on the amount of light received by said detector disposed in said distal end portion;

said transparent optical element including a reflective surface and an optical channel for transmittal light from said light source to said reflective surface and light from said reflective surface to said light detector;

said reflective surface defining a critical angle disposed on a surface of an aircraft so that light is reflected toward said light detector when said reflective surface is in contact with air and refracted toward the external environment when said reflective surface is in contact with ice or water;

temperature sensing means disposed in said optical element adjacent to said reflective surface for sensing the temperature at the surface of the aircraft;

means for pulsating the light source and means including a demodulator and filter for limiting the response from said light detector to light reflected from said light source;

comparator means for comparing reflected light from said light detector to a light threshold and second comparator means for comparing the temperature from said temperature sensing means to a temperature threshold; and means for combining the output of said first and second comparator means to thereby indicate the presence of ice or water on the surface of the aircraft.

2. An optical system for detecting ice and water on the surface of an aircraft according to claim 1, in which said transparent optical element comprises a continuous array of convexeelements extending outwardly from and across one end of said transparent optical element and wherein each of said elements defines a critical angle.

3. An optical system for detecting ice and water on the surface of an aircraft according to claim 1, in which said transparent optical element defines a prism at one end thereof.

4. An optical system for detecting ice and water on the surface of an aircraft according to claim 1, in which said transparent optical element defines a cone at one end thereof.

5. An optical system for detecting ice and water on the surface of an aircraft according to claim 3, in which said prism forms an angle of about 90°.

6. An optical system for detecting ice and water on the surface of an aircraft according to claim 2, in which each of said convex elements define a prism.

7. An optical system for detecting ice and water on the surface of an aircraft according to claim 2, in which each of said prisms form an angle of about 90°.

8. An optical system for detecting ice and water on the surface of an aircraft according to claim 7, in which each of said convex elements have a height of less than about 0.25 inches.

* * * * *